US010856586B2

(12) United States Patent
Hirakubo

(10) Patent No.: US 10,856,586 B2
(45) Date of Patent: Dec. 8, 2020

(54) WOMAN'S UNDERGARMENT WITH CUP SECTIONS

(71) Applicant: Gold Flag Ltd., Osaka (JP)

(72) Inventor: Akiyo Hirakubo, Osaka (JP)

(73) Assignee: GOLD FLAG LTD., Osaka (JP)

( * ) Notice: Subject to any disclaimer, the term of this patent is extended or adjusted under 35 U.S.C. 154(b) by 0 days.

(21) Appl. No.: 16/648,082

(22) PCT Filed: May 24, 2018

(86) PCT No.: PCT/JP2018/019920
§ 371 (c)(1),
(2) Date: Mar. 17, 2020

(87) PCT Pub. No.: WO2019/224965
PCT Pub. Date: Nov. 28, 2019

(65) Prior Publication Data

US 2020/0281282 A1 Sep. 10, 2020

(51) Int. Cl.
*A41C 3/14* (2006.01)
*A41C 3/00* (2006.01)

(52) U.S. Cl.
CPC ..... *A41C 3/142* (2013.01); *A41C 3/0007* (2013.01); *A41C 3/0021* (2013.01)

(58) Field of Classification Search
CPC ... A41C 3/0021; A41C 3/0028; A41C 3/0057; A41C 3/0007; A41C 3/0014; A41C 3/142
USPC ..... 450/59, 60
See application file for complete search history.

(56) References Cited

U.S. PATENT DOCUMENTS 2,134,294 A * 10/1938 Yerkes ..... A41C 3/00 450/59
2,523,715 A * 9/1950 Panes ..... A41C 3/00 450/60
2,592,792 A * 4/1952 Cohen ..... A41C 3/0021 450/63
2,632,168 A * 3/1953 Kaufman ..... A41C 3/0021 450/87
2,842,137 A * 7/1958 Becker ..... A41C 3/0021 450/36

(Continued)

FOREIGN PATENT DOCUMENTS

JP 2001254207 A 9/2001
JP 2005307363 A 11/2005

(Continued)

OTHER PUBLICATIONS

International Search Report dated Jul. 24, 2018 for Application No. PCT/JP2018/019920 and English translation.

*Primary Examiner* — Gloria M Hale
(74) *Attorney, Agent, or Firm* — Lucas & Mercanti, LLP

(57) ABSTRACT

A woman's undergarment with cup sections includes a pair of left and right brassiere cups, cup cover pieces, straps, back pieces, a support panel, and lift-up pieces. A lower edge of each of the brassiere cups is sewn to a lower edge of the lift-up piece. A side edge and an upper edge of the brassiere cup are detached from the cup cover piece. The lift-up piece is disposed between the brassiere cup and the cup cover piece. The brassiere cup has an opening in a corner region including an upper end of the brassiere cup. An insertion portion of the lift-up piece is disposed to pass through the opening.

9 Claims, 10 Drawing Sheets

(56) References Cited

U.S. PATENT DOCUMENTS

| | | | | |
|---|---|---|---|---|
| 8,075,368 | B2 * | 12/2011 | Puyaubreau | A41C 3/14 450/65 |
| 8,690,634 | B2 * | 4/2014 | Heath | A41C 3/0057 450/40 |
| 10,334,891 | B2 * | 7/2019 | Weber-Unger | A41C 3/10 |
| 2006/0223414 | A1 * | 10/2006 | Staub | A41C 3/0057 450/1 |
| 2011/0201252 | A1 * | 8/2011 | Campbell | A41C 3/00 450/39 |
| 2012/0122370 | A1 * | 5/2012 | Heath | A41C 3/0057 450/80 |
| 2014/0349550 | A1 * | 11/2014 | Campbell | A41C 3/0021 450/60 |
| 2015/0056890 | A1 * | 2/2015 | Black | A41C 3/0057 450/86 |
| 2016/0338423 | A1 * | 11/2016 | Weber-Unger | A41C 3/0085 |

FOREIGN PATENT DOCUMENTS

| | | | |
|---|---|---|---|
| JP | 2015212437 | A | 11/2015 |
| JP | 2016069763 | A | 5/2016 |

* cited by examiner

[FIG. 1]
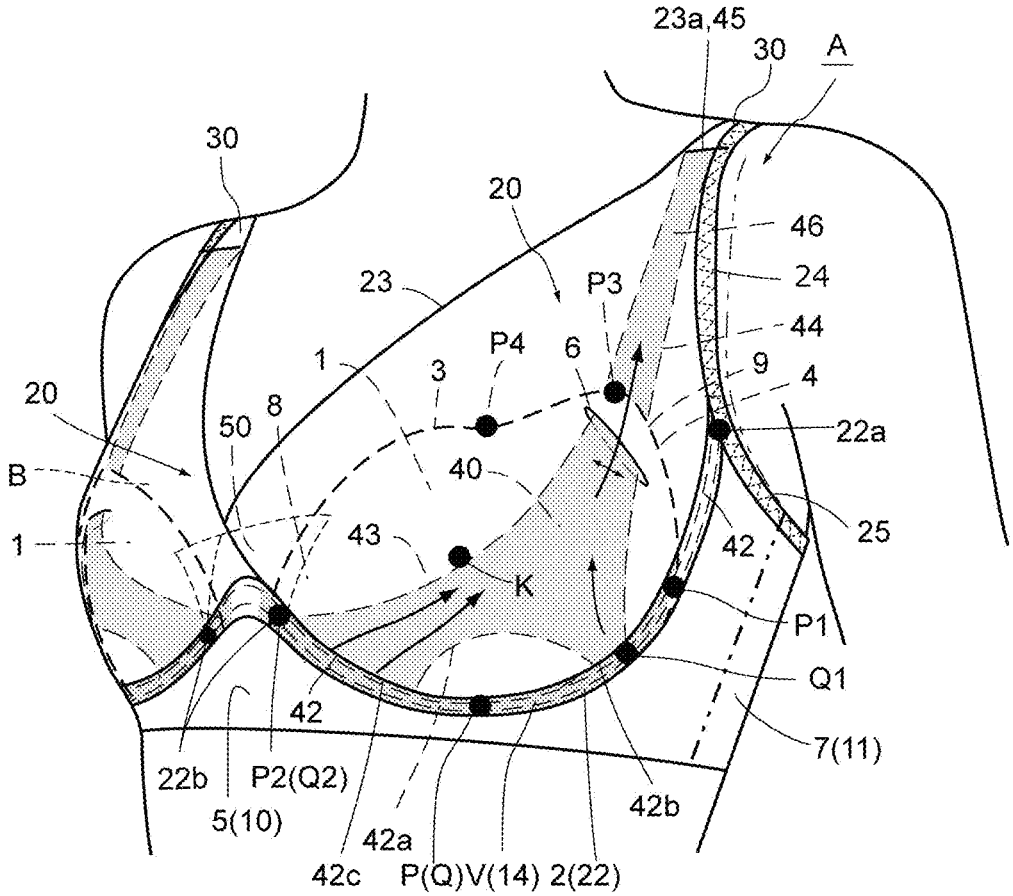

[FIG. 2]
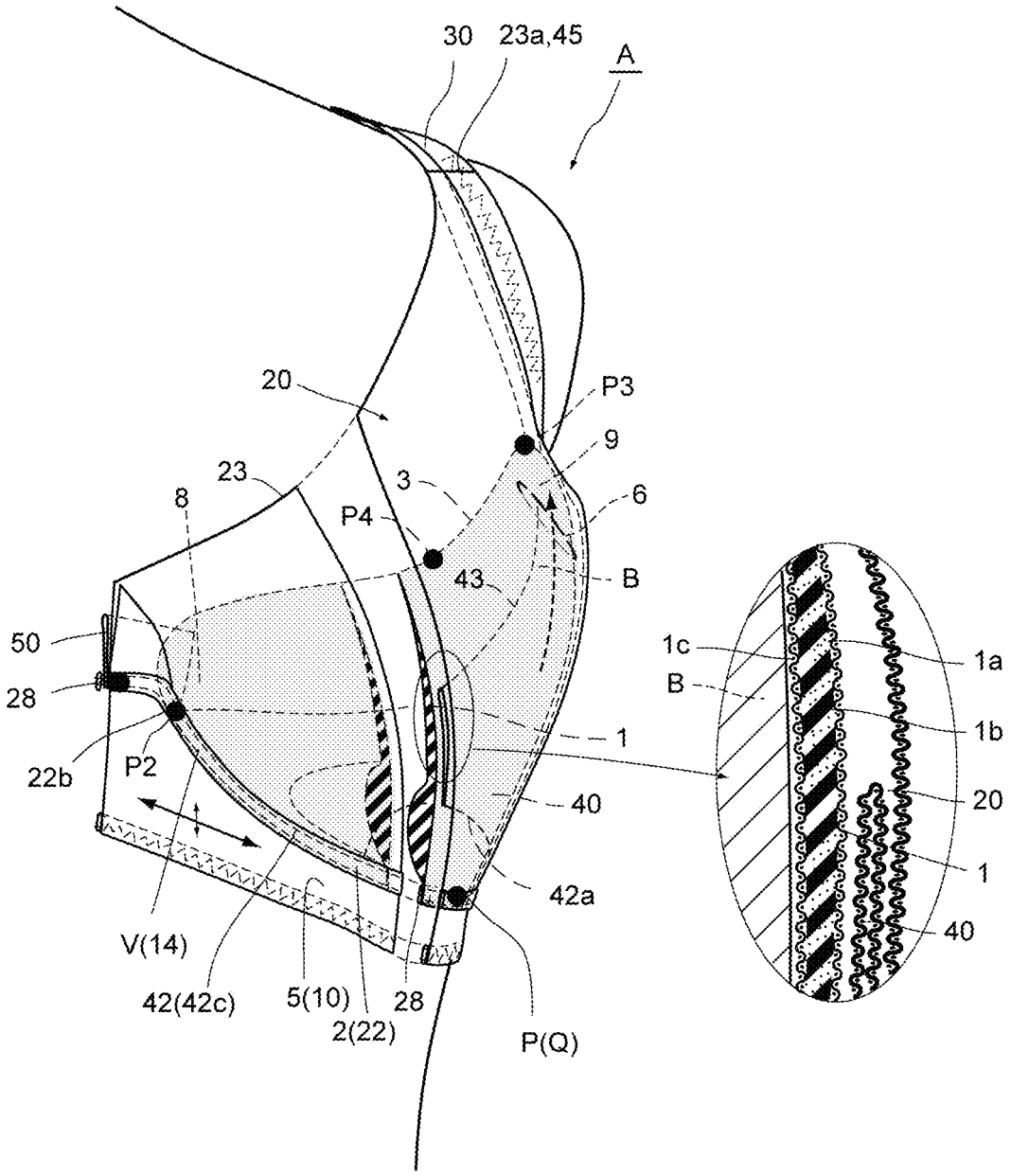

[FIG. 3]
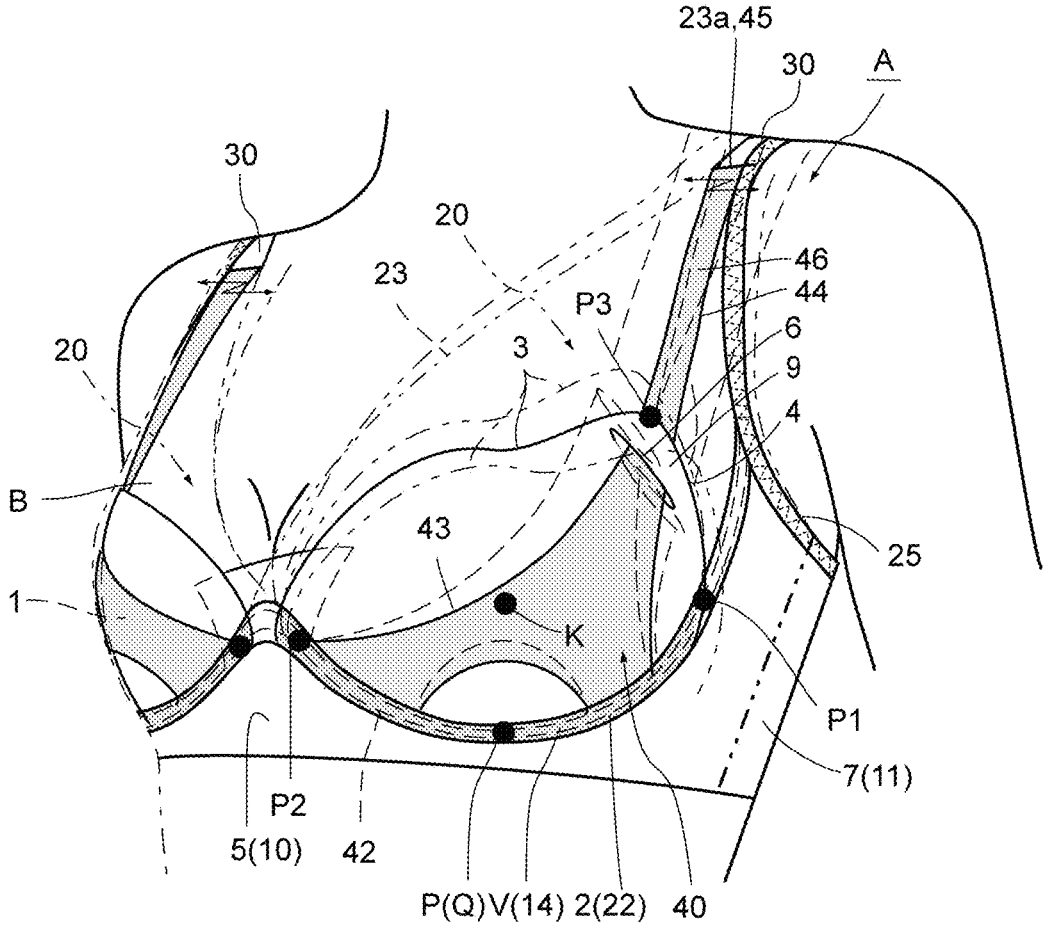

[FIG. 4]
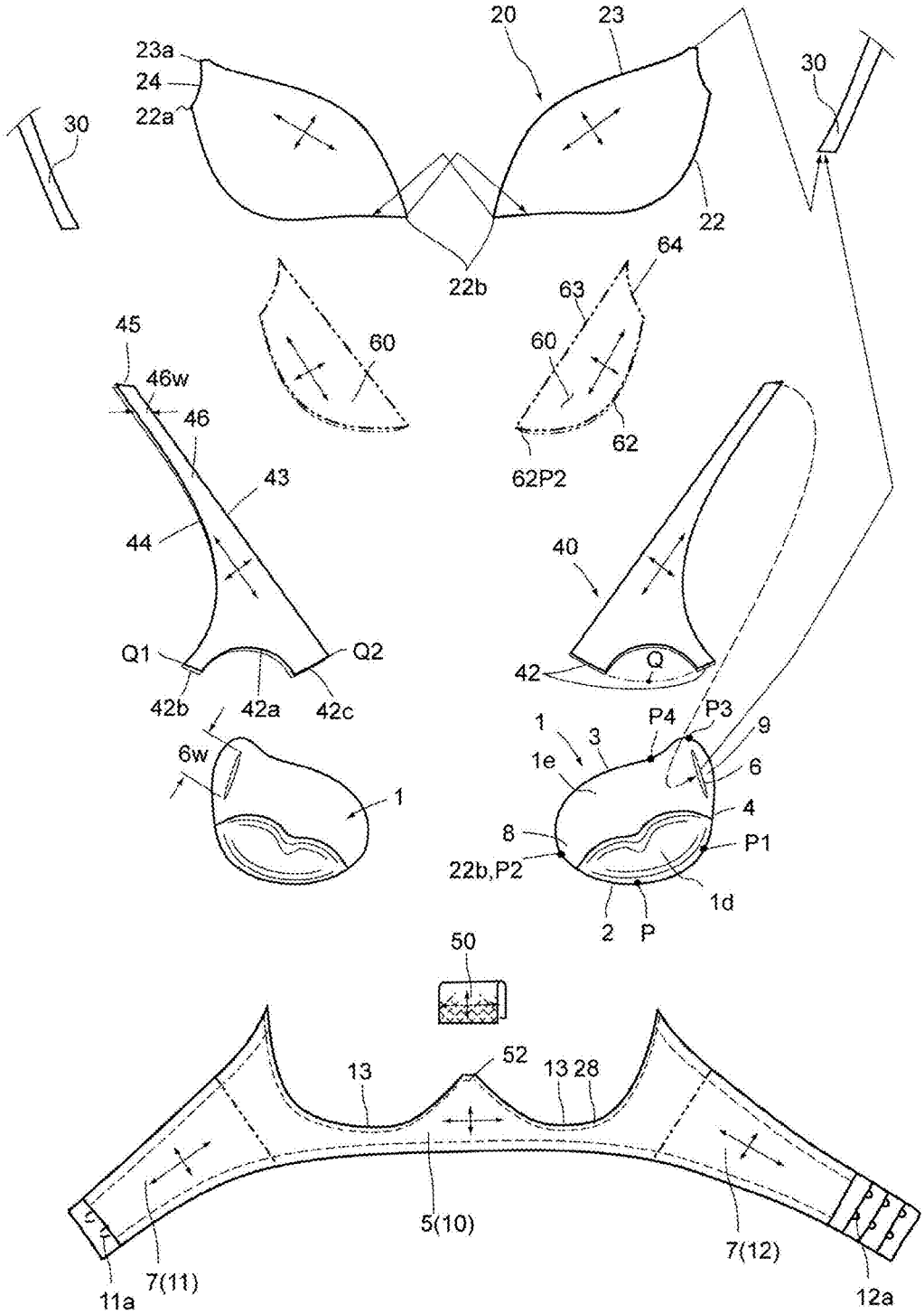

[FIG. 5]
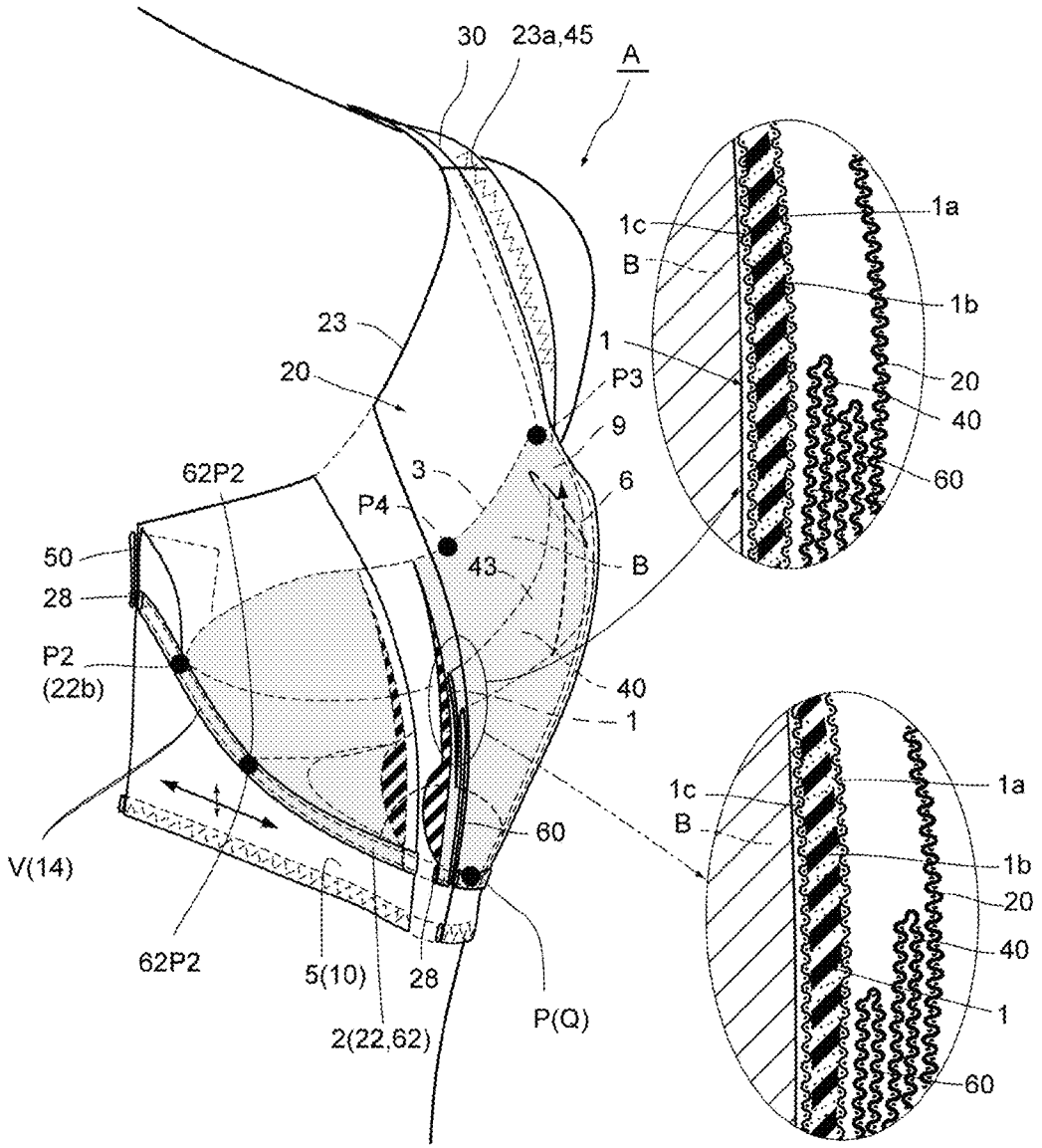

[FIG. 6]
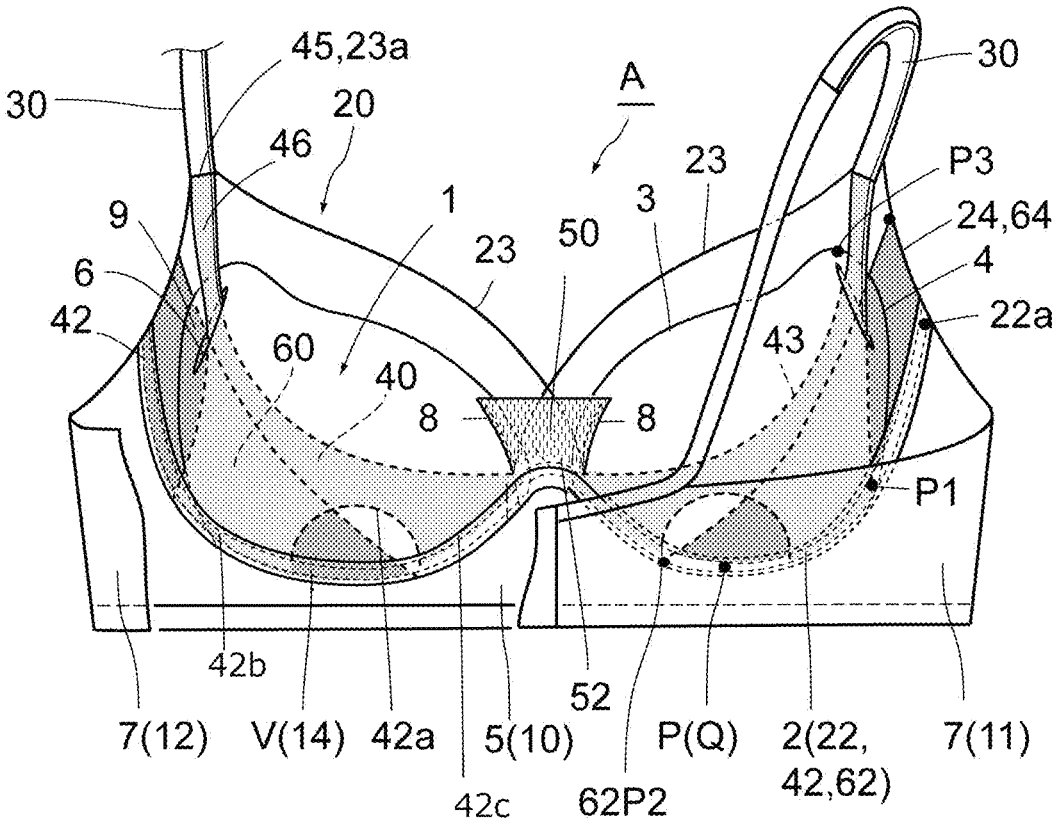

[FIG. 7]
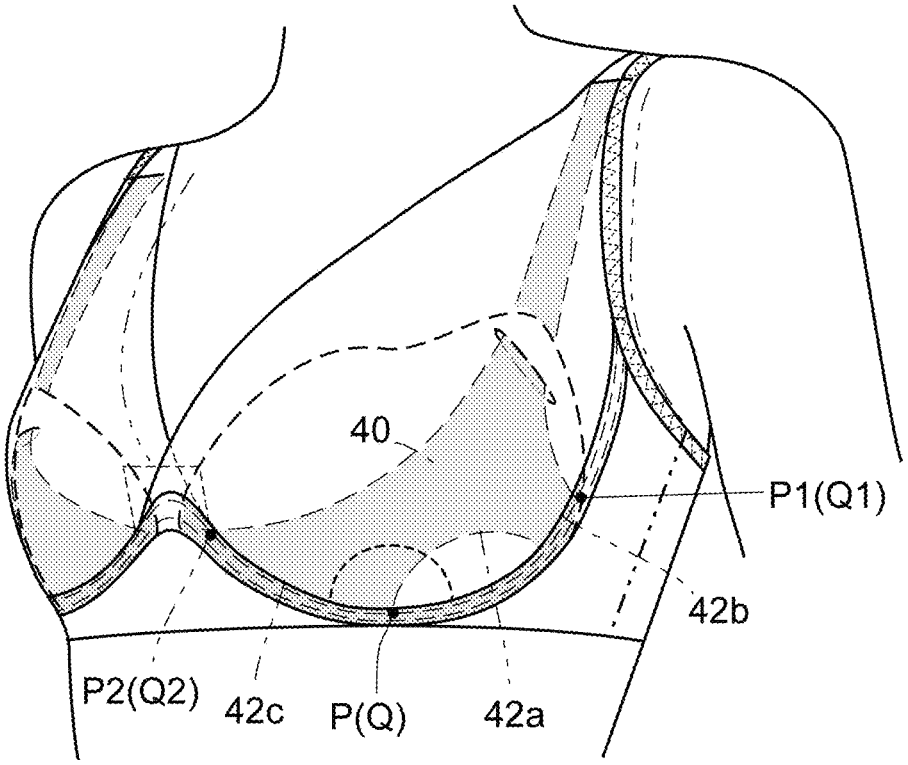

[FIG. 8]
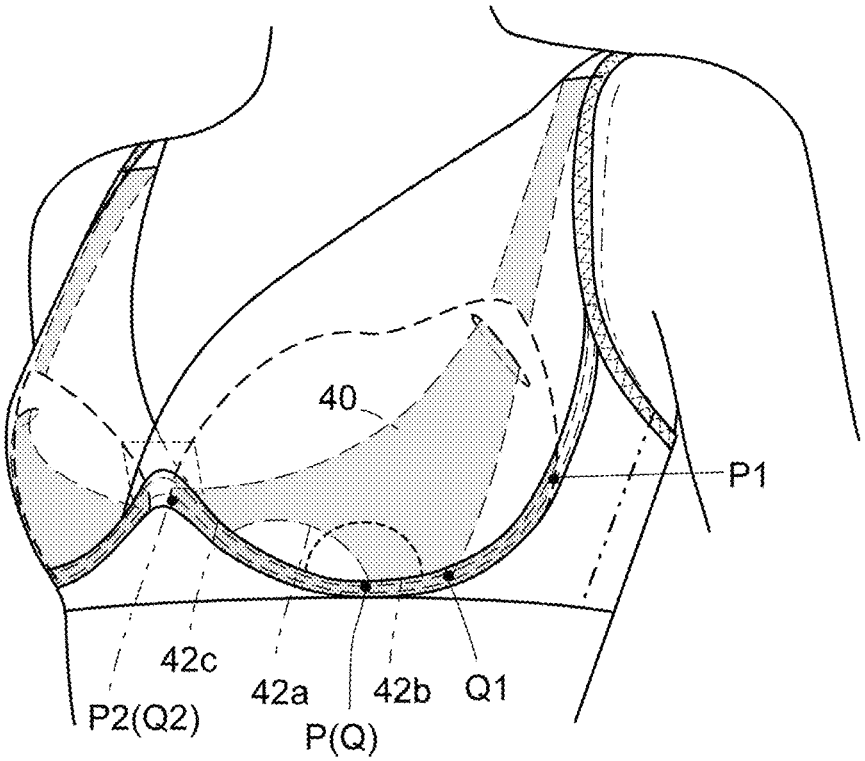

[FIG. 9]
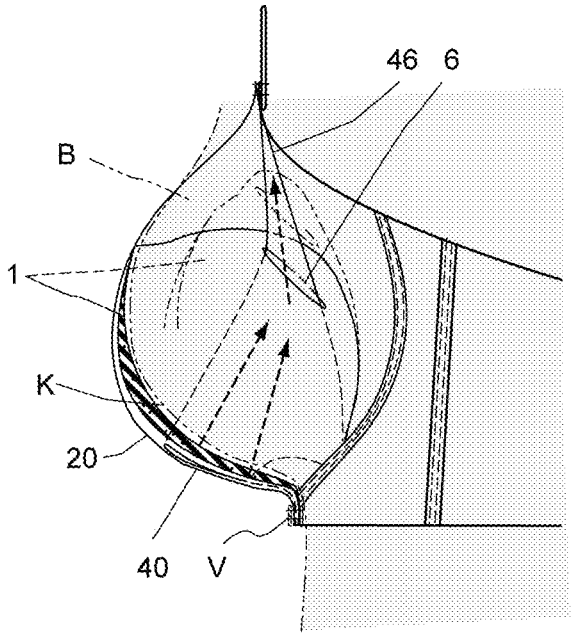

[FIG. 10]
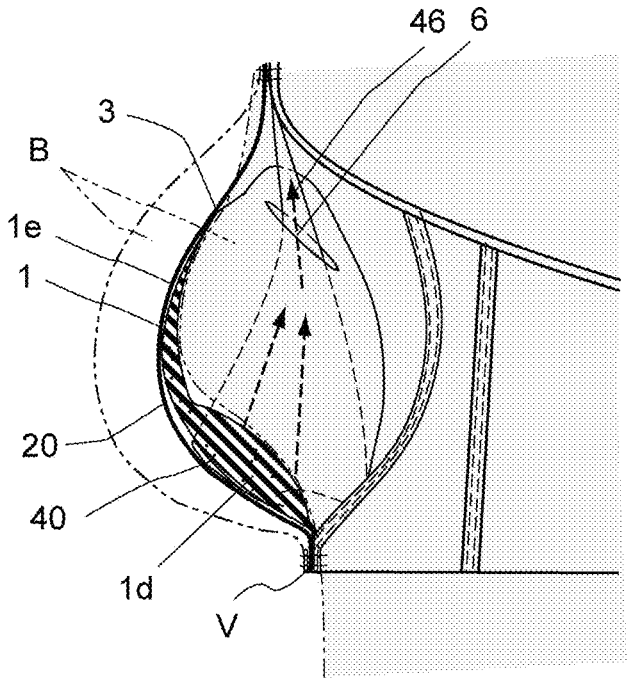

WOMAN'S UNDERGARMENT WITH CUP SECTIONS

CROSS REFERENCE TO RELATED APPLICATION

This Application is a 371 of PCT/JP2018/019920 filed on May 24, 2018, which is incorporated herein by reference.

TECHNICAL FIELD

The present invention relates to women's undergarments with cup sections, such as brassieres and camisoles.

BACKGROUND ART

There are two types of women's undergarments with cup sections, typified by brassieres. One is an underwire cup-type undergarment provided with arc-shaped wires along the lower edges of the cup sections, and the other is a wireless cup-type undergarment without such wires. The latter type of women's undergarments with wire-free cup sections are referred to as "wireless undergarments (or wireless brassieres) for women".

For example, a woman's wireless undergarment (wireless brassiere) includes: left and right cup sections adapted to cover breasts; a support panel optionally sewn to the lower edges of the cup sections to support the cup sections; back portions each extending from the support panel to cover the back; and straps each provided to connect the cup section and the back portion. In the case of a woman's underwire undergarment (brassiere), an arc-shaped wire is inserted along the lower edge of each cup section. This wire helps to maintain the cup section in the arc shape of the wire.

Wearers of women's undergarments have a wide variety of body shapes, especially in breast regions, such as large breasts and small breasts, thick chests and thin chests, broad shoulders and narrow shoulders, and square shoulders and sloping shoulders.

One of the major and common functional requirements for such cup sections of women's undergarments is to push the breasts upwardly and inwardly toward the center of the chest so as to create a beautiful decollete in the neckline area, that is, to enhance the breast-shaping function. Examples of the other important functional requirements include improvements in wearing feeling, such as better fit obtained when form-fitting cup sections are in close contact with wearer's breasts and hold the breasts firmly, regardless of the wearer's body shape, and increased wearing comfort (obtained, for example, when brassiere cups are not detached from the breasts even if the wearer twists her body from side to side, when the breasts do not spill out of the edges of the brassiere cups even if the wearer waves her arms, when the brassiere does not slide up even if the wearer raises her hands, when the straps do not slip off the shoulders even if the wearer turns her shoulders, when the breasts do not swing wildly even if the wearer jumps, and when the back belt of the brassiere does not slide up even if the wearer leans forward).

Patent Literature 1 is an invention relating to a woman's undergarment with an improved breast-shaping function and uses lift-up pieces to create ample breasts. In each of the lift-up pieces, the upper end is sewn to the breast-side end portion of a strap together with the upper lateral corner region of a brassiere cup, and the lower edge is sewn to the cup-shaped edge of a support panel together with the lower edge of the brassiere cup. Thus, the lift-up piece is provided to extend obliquely downward from the breast-side end portion of the strap to the cup-shaped edge of the support panel.

A portion of the brassiere cup covered by the lift-up piece is a region extending in the lower and lateral parts of the outer surface of the brassiere cup, and the lift-up piece entirely covers that region.

The effect of the lift-up pieces is as follows. When a user wears the brassiere, the straps each pull the lift-up piece placed along the contour of the underarm-side and lower parts of the breast in the brassiere cup. Then, the lift-up pieces push the entire breasts inwardly and upwardly, and as a result, the breasts are pushed toward the front center of the chest and a beautiful decollete is created in the neckline area.

Patent Literature 2 is an invention focusing on improvements in the wearing feeling of a woman's undergarment, such as better fit to the breasts and increased wearing comfort of the wearer. This invention includes left and right brassiere cups and front-side pieces that cover the outer surfaces of the cups. The lower edge of each of the brassiere cups is sewn to the cup-shaped edge of a support panel together with the front-side piece, and only the upper end of the front-side piece is sewn to the breast-side end portion of the strap. The upper edge of the brassiere cup is detached from the front-side piece. In other words, all the edges of the brassiere cup except the lower edge are free edges detached from the front-side piece. This type of brassiere is referred to as a "free cup brassiere".

CITATION LIST

Patent Literature

[PTL 1] Japanese Laid-Open Patent Publication No. 2015-212437

[PTL 2] Japanese Laid-Open Patent Publication No. 2016-069763

SUMMARY OF INVENTION

Technical Problem

In the brassiere disclosed in Patent Literature 1, the upper end of the lift-up piece and the upper end of the brassiere cup are sewn together to the breast-side end portion of the strap. When a brassiere cup is sewn to a strap, the position of the brassiere cup depends on the strap, which means that the brassiere cup has poor conformity with the body shape of the wearer. For example, if a broad-shouldered person wears a brassiere having cups suitable for a standard-shouldered person, the distance between the left and right straps is increased for the broader shoulders of the wearer and the brassiere cups sewn to the straps are pulled laterally. As a result, the brassiere cups are shifted laterally from the positions of the breasts, and thus are not in close contact with the breasts and are poorly fitted thereto.

When the wearer moves her body under these conditions, not only the brassiere cups but also the lift-up pieces move in accordance with the movement of the straps.

In addition, when the wearer leans backward or raises her arms, the straps are pulled up and the brassiere cups are lifted more than necessary, which may cause the lower edges of the cups to slide up over the barge scan lines (under-breast curves) of the breasts.

In contrast, in the free cup brassiere of Patent Literature 2, the upper edge of the brassiere cup is free and detached from the front-side piece. Therefore, the upper part of the brassiere cup can move and cover the breast independently of the front-side piece whose upper end is sewn to the strap, without being constrained by the movement of the front-side piece.

The upper edge of the brassiere cup is free from the front-side piece and only the lower edge is sewn and fastened to the front-side piece. This means that like a cantilever, only the lower edge of the brassiere cup is sewn and the unsewn upper edge thereof is unstable without being tied to the front-side piece, although the front-side piece presses the brassiere cup from above. When the wearer moves, e.g., twists her body significantly or leans sideways, the brassiere cup may be deformed to cause the breast to spill out of the upper edge of the cup. This tends to occur frequently in particular when the wearer has large breasts.

In addition, since the wearers of women's undergarments have a wide variety of body shapes and breast sizes, as described above, a wide variety of brassiere sizes such as S, M, L, LL, and even 3L are determined for various consumers' body shapes and a wide variety of cup sizes ranging from A to I are also determined for their various breast sizes.

In an underwire brassiere cup, the shape of the lower edge of the brassiere cup is maintained in the shape of the wire by the shape retaining function of the wire. There are a wide variety of breast sizes, from small to large, as described above. If a wire does not fit the wearer's breast, the wearer feels pain, or a gap formed between the brassiere cup and the breast causes a poor fit.

As a result, for such underwire brassiere cups, various shapes of brassiere cups must be prepared to fit various breast sizes, and therefore underwear manufacturers must offer a wider variety of product lines, which results in an increase in cost.

The present invention has been made in view of the above conventional problems, and it is an object of the present invention to provide a woman's undergarment with cup sections, that not only has improved body-shaping function and fit but also can reduce the variety of products significantly and thereby contribute to cost reduction.

Solution to Problem

A woman's undergarment A with cup sections according to claim 1 includes:

a pair of left and right brassiere cups 1 each adapted to receive a breast B and having a lower edge 2, a side edge 4, and an upper edge 3, the lower edge 2 being downwardly curved, the side edge 4 rising from an underarm-side end P1 of the lower edge 2 toward the upper edge 3, the upper edge 3 extending from a sternum-side end P2 of the lower edge 2 to an upper end P3 of the side edge 4;

cup cover pieces 20 each disposed to cover an outer surface of the brassiere cup 1 and separated from the outer surface of the brassiere cup 1, wherein the lower edge 2 of the brassiere cup 1 extending from the underarm-side end P1 to the sternum-side end P2 is sewn to a lower edge 22 of the cup cover piece 20, and the side edge 4 and the upper edge 3 of the brassiere cup 1 are detached from the cup cover piece 20;

a support panel 10 to which the lower edges 2 of the brassiere cups 1 and the lower edges 22 of the cup cover pieces 20 are sewn together;

back pieces 7 extending from left and right sides of the support panel 10 and adapted to cover a back of a wearer;

straps 30 each extending from the cup cover piece 20 to the back piece 7; and lift-up pieces 40 each disposed between the brassiere cup 1 and the cup cover piece 20, having a lower edge 42 that is sewn to the lower edge 2 of the brassiere cup 1 and an upper end edge 45 that is connected to the strap 30, and thereby configured to lift the brassiere cup 1 from below.

In this undergarment A, the brassiere cup 1 has an opening 6 in a corner region 9 including the upper end P3, the lift-up piece 40 includes an insertion portion 46 having a strip shape extending toward the upper end edge 45, and the insertion portion 46 is inserted through the opening 6 in the corner region 9 of the brassiere cup 1 from the outer surface to an inner surface of the brassiere cup 1.

An invention according to claim 2 is the woman's undergarment A according to claim 1, wherein the opening 6 in the corner region 9 is formed in a slit shape extending in a direction intersecting (perpendicular or approximately perpendicular to) a longitudinal direction of the insertion portion 46.

An invention according to claim 3 is the woman's undergarment A according to claim 2, wherein the opening 6 has a length (slit length) 6*w* greater than a width 46*w* of the insertion portion 46.

An invention according to claim 4 is the woman's undergarment A according to any one of claims 1 to 3, wherein the lower edge 42 of the lift-up piece 40 includes: an unsewn portion 42*a* that is detached from the lower edge 2 of the brassiere cup 1; and sewn portions 42*b* and 42*c* that are provided on both sides of the unsewn portion 42*a* and attached by sewing to the lower edge 2 of the brassiere cup 1.

An invention according to claim 5 is the woman's undergarment A according to claim 4, wherein the unsewn portion 42*a* is formed in a portion of the lower edge 42 of the lift-up piece 40 that includes or is adjacent to a point Q corresponding to a lowest point P on the lower edge 2 of the brassiere cup 1.

Claim 6 is directed to the woman's undergarment A according to claim 4 or 5, wherein a detachment width of the unsewn portion 42*a* is equal to an attachment width of the sewn portion 42*c* on a sternum side and an attachment width of the sewn portion 42*b* on an underarm side is shorter than the detachment width of the unsewn portion 42*a*.

Claim 7 is directed to the woman's undergarment A according to any one of claims 1 to 6, further including sub-lift-up pieces 60 each disposed between the cup cover piece 20 and the lift-up piece 40 or between the lift-up piece 40 and the brassiere cup 1 and separated from the cup cover piece 20 and the lift-up piece 40, or from the lift-up piece 40 and the brassiere cup 1, wherein the sub-lift-up piece 60 has a lower edge 62 that is sewn to the lower edge 22 of the cup cover piece 20 and a side edge (armhole defining edge) 64 that is sewn to a side edge 24 of the cup cover piece 20.

Claim 8 is directed to the woman's undergarment A according to any one of claims 1 to 7, wherein the lower edge 2 of the brassiere cup 1 is free of an underwire.

Advantageous Effects of the Invention

With the configuration described above, it is possible not only to enhance the body-shaping function and the fit but also to reduce the variety of products significantly and thereby reduce the cost.

BRIEF DESCRIPTION OF DRAWINGS

FIG. 1 is a perspective view of a woman's undergarment according to the present invention on a wearer.

FIG. 2 is a vertical center sectional view of the woman's undergarment on the wearer shown in FIG. 1, with a partially enlarged view thereof.

FIG. 3 is a perspective view of the woman's undergarment of FIG. 1, from which cup cover pieces are removed, showing how straps, lift-up pieces, and brassiere cups move.

FIG. 4 is an exploded view of the woman's undergarment according to the present invention.

FIG. 5 is a vertical center sectional view of a woman's undergarment provided with sub-lift-up pieces, with partially enlarged views thereof showing the position of the sub-lift-up piece.

FIG. 6 is a back view of the woman's undergarment shown in FIG. 5.

FIG. 7 is a perspective view of the woman's undergarment in which an unsewn portion of the lift-up piece is located closer to the underarm.

FIG. 8 is a perspective view of the woman's undergarment in which an unsewn portion of the lift-up piece is located closer to the sternum in the center of the chest.

FIG. 9 is a cross-sectional view of a portion of the woman's undergarment on a wearer having large breasts.

FIG. 10 is a cross-sectional view of the portion of the woman's undergarment on a wearer having small breasts.

DESCRIPTION OF EMBODIMENTS

Hereinafter, a woman's undergarment A of the present invention will be described with examples. Examples of the woman's undergarment A of the present invention include all types of undergarments with brassiere cups 1, such as brassiere-type, camisole-type (not shown), and other types of undergarments. In this description, a brassiere is described as a typical example and is denoted by the same reference sign A. A first embodiment of the brassiere A includes lift-up pieces 40, and a second embodiment of the brassiere A further includes sub-lift-up pieces 60.

First Embodiment

The first embodiment of the brassiere A of the present invention is shown in FIG. 1 to FIG. 4. Since FIG. 4 is also used for describing the second embodiment, the sub-lift-up pieces 60 are indicated by imaginary lines therein. The brassiere A includes left and right symmetrical brassiere cups 1, cup cover pieces 20, lift-up pieces 40, an optionally provided support panel 10, back pieces 7 (side belts 11 and 12 in the example shown in these figures), and straps 30.

The brassiere cup 1 may have various shapes, such as a shell shape (not shown) and a heart shape shown in FIG. 4, depending on the breast B and the design. As a typical example, a heart-shaped brassiere cup is described herein.

The brassiere cup 1 is designed to directly receive the breast B and has an outwardly curved bowl shape. The lower edge 2 of the brassiere cup 1 is downwardly curved so as to fit along the barge scan line V of the wearer. The lowest point of the lower edge 2 is denoted by P, and the ends of the lower edge 2 are an underarm-side end P1 and a sternum-side end P2, respectively. The side edge 4 of the brassiere cup 1 rises from the underarm-side end P1 of the lower edge 2 toward the upper edge 3 to form a laterally convex arc with a large radius of curvature. The upper edge 3 is an edge between the upper end P3 of the side edge 4 and the sternum-side end P2 of the lower edge 2 and has an S-shaped snaking line in the present embodiment.

When the upper edge 3 is divided into three or four equal segments, the point at which the curve of the upper edge 3 changes its shape (i.e., the inflection point) is located at a point P4 one-third to one-fourth distance from the upper end P3 (i.e., two-third to three-fourth distance from the sternum-side end P2). A shorter portion of the upper edge 3 from the upper end P3 to the point P4 forms a gentle upward curve, while a longer portion of the upper edge 3 from the sternum-side end P2 to the point P4 also forms a gentle upward curve. These upward curves are connected smoothly to a downward curve at the point P4. The lower edge 2, the upper edge 3, and the side edge 4 are connected smoothly by circular arcs (see FIG. 4).

The lower edge 2, the upper edge 3, and the side edge 4 of the brassiere cup 1 are described separately for easier understanding, but a combination of the upper edge 3 and the side edge 4 may be considered as one upper edge.

A region including and adjacent to the upper end P3 of the brassiere cup 1 is referred to as a corner region 9. This corner region 9 is provided with an opening 6. This opening 6 is a slit-like opening formed in the vicinity of the side edge 4 to extend approximately parallel to the side edge 4 of the brassiere cup 1. As described later, the slit-like opening 6 is formed in a direction intersecting (perpendicular or approximately perpendicular to) the longitudinal direction of an insertion portion 46 to be inserted through the slit-like opening 6.

The length (slit length) 6*w* of the slit-like opening 6 is equal to or greater than the width 46*w* of the insertion portion 46*w* adapted to pass through the opening 6.

The brassiere cup 1 may have various thicknesses. In FIG. 9, the thickness of the brassiere cup 1 is greatest at the top position K (i.e., the highest position of the outer surface of the brassiere cup 1) and gradually decreases toward the periphery.

In another example of the brassiere cup 1, as shown in FIG. 10, the lower half 1*d* of the brassiere cup 1 along its lower edge 2 is thicker than the upper half 1*e*, which has a thickness gradually decreasing from the lower half 1*d* toward the upper edge 3. The entire outer surface of the brassiere cup 1 has a gently outwardly curved bowl shape. The brassiere cup 1 of FIG. 9 does not have a large thickness corresponding to that of the lower half 1*d* but may be provided with a pad to increase the thickness. On the other hand, the thicker lower half 1*d* of the brassiere cup 1 of FIG. 10 may be formed of a pad.

As shown in an enlarged view of FIG. 2, in the present embodiment, the material of the brassiere cup 1 is a sheet-like foam-laminated fabric having a three-layer structure composed of an interlayer 1*b* made of a foam material and thin fabric layers as an outer layer 1*a* and an inner layer 1*c* attached to the interlayer 1*b*, or a sheet-like foam-backed fabric (not shown) having a two-layer structure composed of an interlayer and a thin fabric layer as an outer layer. In the present embodiment, a urethane resin is used as the foam material.

The brassiere cup 1 is formed as follows. An original foam-laminated or foam-backed fabric is cut into a piece of a desired size, the piece is formed into a desired shape by hot press molding, and then burrs are removed by cutting. Thus, a cup of the desired shape is obtained. The brassiere cup 1 formed of such a foam-laminated or foam-backed fabric has flexibility and elasticity. However, this brassiere cup 1 is less stretchable than the lift-up piece 40.

It should be understood that the materials for the brassiere cup 1 are not limited to those described above, and any other known materials such as a nonwoven fabric and a double Raschel fabric may be used.

The cup cover piece 20 is a thin cloth disposed to cover the entire surface of the brassiere cup 1. The upper edge 3 and the side edge 4 of the brassiere cup 1 are not sewn to the cup cover piece 20, and only the lower edge 2 of the brassiere cup 1 is sewn to the lower edge 22 of the cup cover piece 20, and thus the cup cover piece 20 is separated from the outer surface of the brassiere cup 1. A portion of the lower edge 2 of the brassiere cup 1 extending from the underarm-side end P1 to the sternum-side end P2 is sewn to the cup cover piece 20, or the entire length of the lower edge 2 is sewn to the cup cover piece 20 (not shown). The side edge 4 of the brassiere cup 1 rises from a point corresponding to the underarm-side end P1 located on the medial side of the side edge 24 of the cup cover piece 20 serving as a portion of the armhole 25.

The cup cover piece 20 may be a single piece as shown in FIG. 4 or may be composed of two pieces (not shown). When the cup cover piece 20 is composed of two pieces, it has the same shape as that of a single piece if the pieces are sewn together.

The single-piece cup cover piece 20 is formed into a gently sloping bowl shape that conforms to the shape of the outer surface of the brassiere cup 1 by hot press molding. As the material, a fabric that can be formed by hot press molding, such as a power net fabric made of a stretchable material like polyurethane fibers or a knitted lace fabric, is used. Alternatively, a thin lace fabric made of a stretchable material (in particular, a material that is more stretchable in the transverse direction (i.e., a direction perpendicular to the upper edge 23) than in the longitudinal direction (i.e., a direction parallel to the upper edge 23) is used.

The two-piece cup cover piece 20 is composed of an upper part and a lower part. As the material, a fabric which is less stretchable and thus unsuitable for hot press molding is used. The upper part and the lower part are sewn together at the connection portion to form a piece of fabric having an outwardly curved shape that conforms to the shape of the outer surface of the brassiere cup 1.

As shown in FIG. 4, the lower edge 22 of the cup cover piece 20 has a downward "U" shape along the barge scan line V. One end of the lower edge 22 is an armhole-side end 22*a* and the other end thereof is a connecting end 22*b*. The edge serving as a portion of the armhole 25 is a side edge 24 that rises from the armhole-side end 22*a* and extends to the strap connecting portion 23*a*, and the edge extending between the strap connecting portion 23*a* and the connecting end 22*b* is an upper edge 23.

The lower edge 22 of the cup cover piece 20 is longer than the lower edge 2 of the brassiere cup 1, and the lower edge 2 of the brassiere cup 1 is sewn to a portion of the lower edge 22 of the cup cover piece 20 between the armhole-side end 22*a* and the connecting end 22*b*. The lower edge 2 of the brassiere cup 1 from its underarm-side end P1 to its sternum-side end P2 is sewn to the lower edge 22 of the cup cover piece 20.

The cup cover piece 20 is more stretchable obliquely upward from the lower edge 22 toward the strap connecting portion 23*a* (toward the shoulder) but less stretchable in a direction perpendicular to the obliquely upward direction, as shown by arrows in FIG. 4.

It should be noted that the cup cover piece 20 is less stretchable in these directions than a lift-up piece 40 to be described next.

The lift-up piece 40 is provided between the brassiere cup 1 and the cup cover piece 20. The lower edge 42 of the lift-up piece 40 is formed in a shape corresponding to the lower edge 2 of the brassiere cup 1. The upper edge 43 of the lift-up piece 40 is a straight edge extending from the sternum-side end Q2 of the lower edge 42 toward the strap 30, and the side edge 44 of the lift-up piece 40 is an edge extending from the underarm-side end Q1 of the lower edge 42 toward the strap 30. A narrow strip portion between the upper edge 43 and the side edge 44 is an insertion portion 46, and the upper end of the insertion portion 46 is an upper end edge 45 connected to the strap 30. This insertion portion 46 is inserted through the opening 6 of the brassiere cup 1, as described later.

The material of the lift-up piece 40 is a Spandex fabric or a power net fabric. Here, the lift-up piece 40 is a folded double-layer piece, and the upper edge 43 is a folded edge extending in a straight line (FIG. 4). The side edge 44 is inwardly curved to form a deep concave, the insertion portion 46 between the upper part of the upper edge 43 and the upper part of the side edge 44 extends in a narrow strip as described above, and the upper end edge 45 of the insertion portion 46 is connected to the breast-side end of the strap 30. The cut edges of the folded lift-up piece 40 are sewn together to form a double-layer structure.

The sewn portions 42*b* and 42*c* of the lower edge 42 of the lift-up piece 40 are formed to conform to the shape of the lower edge 2 of the brassiere cup 1, as described above. The ends of the lower edge 42 of the lift-up piece 40 are an underarm-side end Q1 and a sternum-side end Q2, respectively, as described above. In the example of FIG. 4, the central portion of the lower edge 42 of the lift-up piece 40 is cut out to form a concave (i.e., the central portion is an imaginary arc that includes a point Q corresponding to the lowest point P of the brassiere cup 1 and extends on both sides of the point Q), and this concave corresponds to the unsewn portion 42*a*. Portions located on both sides of the unsewn portion 42*a* are an underarm-side sewn portion 42*b* and a sternum-side sewn portion 42*c*, respectively.

In the case of FIG. 4, the detachment width of the unsewn portion 42*a* extends on both sides of the point Q corresponding to the lowest point P, as the center of the unsewn portion 42*a*. The detachment width (55 mm to 65 mm) of the unsewn portion 42*a* is almost the same as the width of the sternum-side sewn portion 42*c*. On the other hand, the width (8 mm to 15 mm) of the underarm-side sewn portion 42*b* is narrower and is 15% to 23% of the detachment width of the unsewn portion 42*a*.

FIG. 7 and FIG. 8 each show a modification of the unsewn portion 42*a* of the lower edge 42 of the lift-up piece 40. In these figures, the unsewn portion 42*a* formed in a concave shape in a portion of the lower edge 42 that includes the point Q and extends on both sides of the point Q is indicated by dashed lines, for comparison.

In the case of FIG. 7, the unsewn portion 42*a* is formed to extend from the point Q toward the underarm-side end Q1 (which is substantially corresponds to the underarm-side end P1 of the brassiere cup 1). The sternum-side sewn portion 42*c* plays a central role in lifting the breast B, while the underarm-side sewn portion 42*b* pushes the underarm-side portion of the breast B toward the center of the chest.

In the case of FIG. 8, in contrast, the unsewn portion 42*a* is formed to extend from the point Q toward the sternum-side end Q2. In this case, since the underarm-side end Q1 is located closer to the point Q, a portion near the point Q is pulled up.

As shown in FIG. 4, the lift-up piece 40 is more stretchable in a direction parallel to the upper edge 43 than in a direction perpendicular to the parallel direction, as indicated by crossing arrows. Therefore, when tension is applied to the lift-up piece 40 on the wearer, a high tension is generated in a region between the sternum-side sewn portion 42*c* and the upper end edge 45 and thus the lift-up piece 40 is significantly stretched from the sternum-side sewn portion 42*c* toward the shoulder. On the other hand, the lift-up piece 40 is less stretchable in a direction from the underarm-side sewn portion 42*b* toward the upper end edge 45 and thus a portion of the breast B corresponding to that less stretchable region is pushed (medially) toward the sternum in the center of the chest effectively.

When the sternum-side sewn portion 42*c* is wider as shown in FIG. 7, it can lift a larger portion of the breast. When the underarm-side sewn portion 42*b* is wider as shown in FIG. 8, it can push the breast toward the center of the chest more effectively.

Since the tension of the lift-up piece 40 is not applied to the above-mentioned unsewn portion 42*a*, a portion of the breast B corresponding to this portion is prevented from sliding upward.

Although not shown in the figures, the unsewn portion 42*a* does not necessarily have to be provided. Instead, the entire lower edge 42 of the lift-up piece 40 may be cut into a shape conforming to the lower edge 2 of the brassiere cup 1 and sewn to the lower edge 2 of the brassiere cup 1.

The support panel 10 serving as a front portion 5 of the woman's undergarment A is optionally provided. Here, the undergarment A provided with the support panel 10 is shown as a typical example. For example, as shown in FIG. 4, the support panel 10 has left and right cup-shaped edges 13 that form a W shape composed of two arcs. Side belts 11 and 12 serving as left and right back pieces 7 of the woman's undergarment A extend in the left and right directions from the support panel 10 (or from the cup cover pieces 20, although not shown in the figures).

The lower edges 22 of the left and right cup cover pieces 20, the sewn portions 42*b* and 42*c* of the lower edges 42 of the lift-up pieces 40, the lower edges 2 of the brassiere cups 1, and a non-stretchable tape 28 are stacked on top of one another and sewn together to the cup-shaped edges 13, and thus a narrow strip-like W-shaped cup supporting portion 14 is formed.

In the present embodiment, this portion (the cup supporting portion 14) is not provided with an underwire. Therefore, unlike underwire brassiere cups, the shape of the cup supporting portion 14 serving as the lower edges of the cup sections is not uniquely determined. The cup supporting portion 14 is more flexible than the underwire of the brassiere cups. The cup supporting portion 14 is thick and flexible but does not have longitudinal stretchability. The cup supporting portion 14 softly touches the barge scan lines V of the breasts B of the wearer. The tension of the lift-up pieces 40 along the cup supporting portion 14 is generated in the sewn portions 42*b* and 42*c* of the lift-up pieces 40, as described above.

In the embodiment shown in the figures, the supporting panel 10 and the side belts 11 and 12 are made of a fabric, such as a lace fabric. The end of one side belt 11 is provided with male engaging members 11*a*, while the end of the other side belt 12 is provided with female to-be-engaged members 12*a*. The support panel 10 and the side belts 11 and 12 are more elastically stretchable in their longitudinal (lengthwise) directions than in their transverse (widthwise) directions, as shown by crossing arrows in FIG. 4.

When the support panel 10 is not provided (not shown), the connecting ends 22*b* of the brassiere cups 1 are connected directly to each other, and the non-stretchable tape 28 and the lower edges 2 of the brassiere cups 1 are sewn together so as to increase the strength. In this case, the side belts 11 and 12 serving as the back pieces 7 of the woman's undergarment A extend in the left and right directions from the lower edges 22 of the cup cover pieces 20 (in particular, from portions of the lower edges 22 each between a position corresponding to the lowest point P of the brassiere cup 1 and a position corresponding to the underarm-side end P1 thereof), although not shown in the figures.

The cup connecting piece 50 is a piece of cloth for connecting the left and right brassiere cups 1 adjacent to each other at their adjacent portions (abutting portions) 8 near the sternum-side ends P2 of the upper edges 3. As the cup connecting piece 50, a highly stretchable double-folded fabric such as a power net fabric is used. The cup connecting piece 50 is more elastically stretchable in a direction connecting the left and right brassiere cups 1 than in a direction perpendicular to that connecting direction. The side edges of the cup connecting piece 50 are sewn to the adjacent portions 8 near the sternum-side ends P2 as described above, and the lower edge of the cup connecting piece 50 is sewn to a portion, of the narrow strip-like W-shaped cup supporting portion 14, including an inverted U-shaped portion 52 located between the left and right cup-shaped edges 13 of the support panel 10.

Since the cup connecting piece 50 is used to connect the left and right brassiere cups 1, it is exposed to the outside through a space between the brassiere cups 1. In this embodiment, the shape, structure, and location of the cup cover pieces 20 are changed to hide the cup connecting piece 50.

More specifically, the connecting end 22*b* of the left cup cover piece 20 reaches the lower edge 2 of the right brassiere cup 1 and the connecting end 22*b* of the right cup cover piece 20 reaches the lower edge 2 of the left brassiere cup 1, so that the cup cover pieces 20 overlap each other above the cup connecting piece 50 to hide it.

Each of the lift-up pieces 40, which are sewn to the support panel 10 at their sewn portions 42*b* and 42*c* of the lower edges 42, covers the lower part of the outer surface of the brassiere cup 1 disposed behind the lift-up piece 40, and the insertion portion 46 of the lift-up piece 40 is inserted through the slit-like opening 6 from the outer surface to the inner surface. The upper end edge 45 of the lift-up piece 40 is connected to one end (i.e., the breast-side end) of the strap 30 together with the strap connecting portion 23*a* of the cup cover piece 20.

The other end (i.e., the back-side end) of the strap 30 is connected to the center of the upper edge of the side belt 11 (or 12).

The width 46*w* of the insertion portion 46 of the lift-up piece 40 is equal to or smaller than the slit-like opening length 6*w* of the slit-like opening 6, as described above. In the case where the width 46*w* of the insertion portion 46 is smaller than the slit length 6*w*, the insertion portion 46 can move more easily in its longitudinal direction through the slit-like opening 6 than in the case where the slit length 6*w* is equal to the width 46*w* of the insertion portion 46, because the contact resistance in the former case is lower than that in the latter case. Furthermore, when the slit-like opening length 6*w* is greater than the width 46*w* of the insertion portion 46, the range of motion of the insertion portion 46 increases in the slit length direction. Therefore, even if the position of the strap 30 varies depending on the wearer's body shape (for example, the distance between the left and right straps 30 increases when the wearer has broad shoulders, while the distance decreases when the wearer has narrower shoulders), the slit-like opening 6 with an extra length accommodates the positional variations of the strap and thus the brassiere cup 1 can always be located over the breast B.

As seen from FIG. 1, the upper edge 43 of the lift-up piece 40 passes through or slightly above or below a position corresponding to the top position K of the brassiere cup 1.

Next, the operations of the woman's undergarment A on a wearer will be described. When the woman's undergarment A is worn, the side belts 11 and 12 are connected by engaging members 11*a* and to-be-engaged members 12*a* and thus the support panel 10 stretches and fits snugly against the chest of the wearer, while the straps 30 pull up the cup cover pieces 20 and the lift-up pieces 40 toward the shoulders, as shown by arrows (see FIG. 1).

The cup supporting portion 14 fits under the barge scan lines V of the breasts B and supports them from below. Since the cup supporting portion 14 is not provided with an underwire, it flexibly changes its shape to conform to the size of the breasts B or the shape of the barge scan lines V of the breasts B and thus softly touches the barge scan lines V, although it is not stretchable.

Although the entire lower edge 2 of the brassiere cup 1 and the lower edge 22 of the cup cover piece 20 are sewn together as described above, the unsewn portion 42*a* including the lowest point Q (i.e., the point corresponding to the lowest point P of the brassiere cup 1) of the lower edge 42 of the lift-up piece 40 is detached from the lower edges 2 and 22 and the sewn portions 42*b* and 42*c* located on both sides of the unsewn portion 42*a* are attached thereto by sewing. Therefore, the brassiere cup 1 is pulled up at the sewn portions 42*b* and 42*c*, and a portion (a lower central portion) of the breast B is slightly pushed into a space formed between the cup supporting portion 14 and the unsewn portion 42*a*.

The insertion portion 46 of the lift-up piece 40 is inserted through the slit-like opening 6 provided in a corner region 9 of the brassiere cup 1 from the outer surface to the inner surface. This insertion portion 46 can easily move in its longitudinal direction through the slit-like opening 6 with an extra length. A portion of the insertion portion 46 inserted through the slit-like opening 6 is narrower than the slit-like opening 6 as described above, but as seen from FIG. 1, the width of the insertion portion 46 suddenly increases from a position slightly below the slit-like opening 6 (for example, a position about 10 mm below the slit-like opening 6 toward the lower edge 42) and exceeds the slit length 6*w*. Thus, the unlimited longitudinal movement of the insertion portion 46 through the brassiere cup 1 is prevented.

In this relationship between the brassiere cup 1 and the lift-up piece 40, when the strap 30 moves in the horizontal direction, the insertion portion 46 also moves in its width direction (i.e., the slit length direction of the opening 6) and is caught on the edge of the slit-like opening 6, and thus the brassiere cup 1 also moves by a distance equal to that of the movement of the strap 30 after the insertion portion 46 is caught on the edge. In other words, the movement of the upper edge 3 and the side edge 4 of the brassiere cup 1 is limited within a certain range in the horizontal direction by the insertion portion 46 thus inserted. More specifically, the upper edge 3 and the side edge 4 of the brassiere cup 1 are not completely free. The movement of these edges are limited within a certain range by the lift-up piece 40, and thus the instability of the brassiere cup 1 is eliminated.

When the brassiere A is worn, if the breast B is too large to be received in the brassiere cup 1 as shown in FIG. 9, the brassiere cup 1 is pushed by the large breast B therein and leans forward, with the lower edge 2 fixed as a fulcrum. In this case, the insertion portion 46 of the lift-up piece 40 smoothly moves downward through the slit-like opening 6 of the brassiere cup 1, and thus the brassiere cup 1 can receive and cover the breast B.

In contrast, if the breast B is too small for the brassiere cup 1, the brassiere cup 1 rises upward, with the lower edge 2 fixed as a fulcrum, under the tension of the cup cover piece 20 that covers the outer surface of the brassiere cup 1. In this case, the insertion portion 46 of the lift-up piece 40 smoothly moves upward through the slit-like opening 6 of the brassiere cup 1, and the brassiere cup 1 can receive and cover the breast B.

This leaning and rising of the brassiere cup 1 is performed by the cup cover piece 20 that is connected to the strap 30 and covers the entire outer surface of the brassiere cup 1.

With the use of the brassiere cup 1 having a thicker lower half 1*d* (or having a lower half 1*d* provided with a thick pad) as shown in FIG. 10, the effect of increasing the volume of the breast can be enhanced.

In either case, since the brassiere cup 1 can lean forward or rise upward as described above, it can receive breasts with a wider range of sizes. In addition, since the cup supporting portion 14 is a wireless portion without an underwire, a cup of a size can cover cup sizes around that size, and thus the number of cup sizes can be reduced from that of conventional brassieres provided with underwires.

Next, how the woman's undergarment A works when the wearer moves, twists, or stretches her body will be described. When the wearer of the woman's undergarment A moves, the lift-up piece 40 is pulled up by the strap 30. The lower part of the brassiere cup 1 is pulled up by the two sewn portions 42*b* and 42*c* of the lift-up piece 40. Since the cup supporting portion 14 is caught on a portion of the barge scan line V of the breast B corresponding to the unsewn portion 42*a* between the sewn portions 42*b* and 42*c* as described above, the brassiere cup 1 is prevented from sliding upward. Thus, a high degree of fit can be obtained.

Second Embodiment

Next, the second embodiment provided with sub-lift-up pieces 60 will be described. The sub-lift-up pieces 60 are optionally provided, as indicated by imaginary lines (two-dot chain lines) in FIG. 4. Each of the sub-lift-up pieces 60 is a double-folded piece with its upper edge 63 being a folded edge, is made of the same fabric as the lift-up piece 40, and has a crescent shape in front view. The lower edge 62 of the sub-lift-up piece 60 and the lower edge 2 of the brassiere cup 1 are sewn together to serve as a part of the cup supporting portion 14. The armhole defining edge 64 of the sub-lift-up piece 60 is sewn to the side edge 4 of the brassiere cup 1, and the upper edge 63 thereof is a free edge.

As seen in the cross sections encircled in FIG. 5, the sub-lift-up piece 60 is provided between the cup cover piece 20 and the lift-up piece 40 or between the lift-up piece 40 and the brassiere cup 1.

The sub-lift-up piece 60 is separated from the cup cover piece 20 and the lift-up piece 40, or from the lift-up piece 40 and the brassiere cup 1.

The sternum-side end 62P2 of the sub-lift-up piece 60 coincides with the sternum-side end of the unsewn portion 42*a* of the lift-up piece 40 (FIG. 6). Thereby, the sub-lift-up piece 60 covers a portion of the lift-up piece 40 along the unsewn portion 42*a* and the narrower underarm-side sewn portion 42*b*, and thus reinforces the portion of the lift-up piece 40 along the unsewn portion 42*a* and the narrower underarm-side sewn portion 42*b*.

REFERENCE SIGNS LIST

A: Woman's undergarment
B: Breast
K: Top position
P: Lowest point
P1: Underarm-side end
P2: Sternum-side end
P3: Upper end of side edge
P4: Point one-third to one-fourth distance from upper end of side edge
Q: Lowest point of lift-up piece
Q1: Underarm-side end of lift-up piece
Q2: Sternum-side end of lift-up piece
V: Barge scan line
1: Brassiere cup
1*a*: Outer layer
1*b*: Interlayer
1*c*: Inner layer
1*d*: Lower half
1*e*: Upper half
2: Lower edge
3: Upper edge
4: Side edge
5: Front panel
6: Opening
6*w*: Length of opening (slit length)
7: Back piece
8: Adjacent portion near sternum-side end of brassiere cup
9: Corner region of brassiere cup
10: Support panel
11, 12: Side belts
11*a*: Engaging member
12*a*: To-be-engaged member
13: Cup-shaped edge
14: Cup supporting portion
20: Cup cover piece
22: Lower edge
22*a*: Armhole-side end
22*b*: Connecting end
23: Upper edge of cup cover piece
23*a*: Strap connecting portion
24: Side edge
25: Armhole
28: Tape
30: Strap
40: Lift-up piece
42: Lower edge of lift-up piece
42*a*: Unsewn portion
42*b*: Underarm-side sewn portion
42*c*: Sternum-side sewn portion
43: Upper edge of lift-up piece
44: Side edge of lift-up piece
45: Upper end edge
46: Insertion portion
46*w*: Width of insertion portion
50: Cup connecting piece
52: Inverted U-shaped portion
60: Sub-lift-up piece
62: Lower edge of sub-lift-up piece
62P2: Sternum-side end
63: Upper edge
64: Armhole defining edge (side edge)

The invention claimed is:

1. A woman's undergarment with cup sections, comprising:

a pair of left and right brassiere cups each adapted to receive a breast and having a lower edge, a side edge, and an upper edge, the lower edge being downwardly curved, the side edge rising from an underarm-side end of the lower edge toward the upper edge, the upper edge extending from a sternum-side end of the lower edge to an upper end of the side edge;

cup cover pieces each disposed to cover an outer surface of the brassiere cup and separated from the outer surface of the brassiere cup, wherein the lower edge of the brassiere cup extending from the underarm-side end to the sternum-side end is sewn to a lower edge of the cup cover piece, and the side edge and the upper edge of the brassiere cup are detached from the cup cover piece;

a support panel having cup-shaped edges that are sewn to the lower edges of the brassiere cups and the lower edges of the cup cover pieces;

back pieces extending from left and right sides of the support panel and adapted to cover a back of a wearer;

straps each extending from the cup cover piece to the back piece; and lift-up pieces each disposed between the brassiere cup and the cup cover piece, having a lower edge that is sewn to the lower edge of the brassiere cup and an upper end edge that is connected to the strap, and thereby configured to lift the brassiere cup from below, wherein the brassiere cup has an opening in a corner region including the upper end, the lift-up piece includes an insertion portion having a strip shape extending toward the upper end edge, and the insertion portion is inserted through the opening in the corner region of the brassiere cup from the outer surface to an inner surface of the brassiere cup.

2. The woman's undergarment according to claim 1, wherein the opening in the corner region is formed in a slit shape extending in a direction intersecting a longitudinal direction of the insertion portion.

3. The woman's undergarment according to claim 2, wherein the opening has a length greater than a width of the insertion portion.

4. The woman's undergarment according to claim 1, wherein the lower edge of the lift-up piece includes: an unsewn portion that is detached from the lower edge of the brassiere cup; and sewn portions that are provided on both sides of the unsewn portion and attached by sewing to the lower edge of the brassiere cup.

5. The woman's undergarment according to claim 4, wherein the unsewn portion is formed in a portion of the lower edge of the lift-up piece that includes or is adjacent to a point corresponding to a lowest point on the lower edge of the brassiere cup.

6. The woman's undergarment according to claim 4, wherein a detachment width of the unsewn portion is equal to an attachment width of the sewn portion on a sternum side and an attachment width of the sewn portion on an underarm side is shorter than the detachment width of the unsewn portion.

7. The woman's undergarment according to claim 1, further comprising left and right sub-lift-up pieces each disposed between the cup cover piece and the lift-up piece, having a lower edge that is sewn to the lower edge of the cup cover piece and a side edge that is sewn to a side edge of the cup cover piece, and thereby separated from the cup cover piece and the lift-up piece.

8. The woman's undergarment according to claim 1, wherein the lower edge of the brassiere cup is free of an underwire.

9. The woman's undergarment according to claim 1, further comprising left and right sub-lift-up pieces each disposed between the lift-up piece and the brassiere cup, having a lower edge that is sewn to the lower edge of the cup cover piece and a side edge that is sewn to a side edge of the cup cover piece, and thereby separated from the lift-up piece and the brassiere cup.

* * * * *